US012324488B2

(12) United States Patent
Calderoni et al.

(10) Patent No.: US 12,324,488 B2
(45) Date of Patent: Jun. 10, 2025

(54) BUTTON

(71) Applicant: Rilo Energy S.r.l., Turin (IT)

(72) Inventors: Gianluca Calderoni, Turin (IT); Claudio Facciorusso, Turin (IT)

(73) Assignee: Rilo Energy S.r.l., Turin (IT)

( * ) Notice: Subject to any disclaimer, the term of this patent is extended or adjusted under 35 U.S.C. 154(b) by 0 days.

(21) Appl. No.: 18/371,643

(22) Filed: Sep. 22, 2023

(65) Prior Publication Data

US 2024/0099430 A1 Mar. 28, 2024

(30) Foreign Application Priority Data

Sep. 23, 2022 (IT) ..... 102022000019620

(51) Int. Cl.
*A44B 1/32* (2006.01)
*A44B 1/04* (2006.01)

(52) U.S. Cl.
CPC . *A44B 1/32* (2013.01); *A44B 1/04* (2013.01)

(58) Field of Classification Search
CPC .... A44B 1/32; A44B 1/04; A44B 1/34; A44B 1/00; A44B 1/08; A44B 1/18; A44B 1/28; F16B 5/04; F16B 5/0096; F16B 19/1081; F16B 19/08
See application file for complete search history.

(56) References Cited

U.S. PATENT DOCUMENTS 878,683 A * 2/1908 Stashko ..... A44B 1/34 24/108
4,035,874 A * 7/1977 Liljendahl ..... A44B 1/34 411/339
4,662,033 A * 5/1987 Wieland, Jr. ..... A44B 1/08 24/92
4,683,621 A * 8/1987 Watanabe ..... A44B 1/44 24/95
5,093,965 A * 3/1992 Mauras ..... A44B 1/08 24/92
5,467,510 A * 11/1995 Hartzell ..... A41B 11/002 24/104
5,513,422 A * 5/1996 Wen-Lung ..... A44B 1/06 24/92

(Continued)

FOREIGN PATENT DOCUMENTS

DE 805194 5/1951
DE 10202128 9/2002

OTHER PUBLICATIONS

DE805194C English Translation by EPO and Google, Oct. 19, 2024, 4 pages. (Year: 2024).*

*Primary Examiner* — Jason W San
*Assistant Examiner* — Louis A Mercado
(74) *Attorney, Agent, or Firm* — Erik J. Overberger; RANKIN, HILL & CLARK LLP

(57) ABSTRACT

A button including a bottom element which has a stem extending along an axial direction, a closing element which has a pin extending along the axial direction internally to the stem, the pin being configured to bind to the stem, a fixing element having a trunk extending along the axial direction externally to the stem, the trunk being configured to receive and bind to the stem. The stem is configured to be coupled with interference fit internally with the pin and externally with the trunk so that the trunk causes a radial clamping action on the stem and, through the stem, on the pin.

7 Claims, 4 Drawing Sheets

(56) References Cited

U.S. PATENT DOCUMENTS

| | | | | |
|---|---|---|---|---|
| 5,644,820 | A * | 7/1997 | Ho | A44B 1/34 24/92 |
| 7,251,865 | B2 * | 8/2007 | Takamura | A44B 1/34 24/691 |
| 2017/0354208 | A1 | 12/2017 | Park | |

* cited by examiner

BUTTON

FIELD OF APPLICATION

The present invention relates to a button, in particular a decorative interlocking button for clothing.

DESCRIPTION OF THE PRIOR ART

The use of interlocking buttons for fabrics and clothing is known in the art. These buttons are generally associated with a closing or decorative function.

The use of two complementary components for the manufacture of these buttons is also known. In particular, a closing element, provided with a protrusion, and a bottom element provided with a cavity adapted to receive said protrusion of the closing element are used.

The interlocking buttons with closing function envisage the superimposition and consequent locking of the two constituent elements through the application of an external force, with possibility of separating the aforementioned components by the application of an external force contrary to the first one.

In the prior art, the use of interlocking buttons with a decorative function, fixed to first garments, instead envisage the impossibility of separating the two constituent elements in order to avoid the reuse of the aforementioned buttons on garments different from those originally used.

In addition, it is known to use resilient materials, such as plastic, for the manufacture of the constituent components of such buttons. Specifically, the manner of binding the constituent elements always envisage the sole superposition of the components and consequent application of a pressure on the closing element to bind it to the bottom element.

In the prior art, the need is felt to develop new modes of binding the elements to allow a more stable coupling and a more effective fixing of the elements of the button.

Problem of the Prior Art

In the prior art, the interlocking buttons deploy a non-functional coupling and closing mode to prevent the separation of the constituent components of the button and the possible reuse of the aforementioned button. In fact, the application of an external force to divide the two elements allows them to be separated after a breakage of the components themselves of the button.

To improve the coupling of the components of the button, a firmer and more stable fixing mode is required.

SUMMARY OF THE INVENTION

Aim of the invention in question is that of making a button whose components are effectively bound by a stable coupling and which cannot be decoupled.

More in detail, the aim of the present invention is that of making a decorative button whose constituent elements are irreversibly fixed to each other by means of a mechanical interlocking.

The specified technical task and the specified purposes are substantially achieved by a button comprising a bottom element which comprises a stem extending along an axial direction, a closing element which comprises a pin extending along the axial direction internally to the stem, the pin being configured to bind to the stem, a fixing element comprising a trunk extending along the axial direction externally to the stem, the trunk being configured to receive and bind to the stem, wherein the stem is configured to be coupled with interference fit internally with the pin and externally with the trunk so that the trunk causes a radial clamping action on the stem and, through the stem, on the pin.

Advantages of the Invention

Thanks to an embodiment, it is possible to obtain a decorative button that allows to obtain a stable mechanical interlocking coupling of the constituent elements.

Thanks to an embodiment, it is possible to make a decorative button that allows to obtain a stable mechanical interlocking coupling of the constituent elements, which is irreversible.

Thanks to an embodiment, it is possible to bind a decorative button that allows to obtain a stable and irreversible coupling of the constituent elements to an item of clothing.

BRIEF DESCRIPTION OF THE DRAWINGS

The characteristics and advantages of the present invention will be apparent from the following detailed description of a possible practical embodiment, illustrated by way of non-limiting example in the set of drawings, in which.

DETAILED DESCRIPTION

Figure 1:
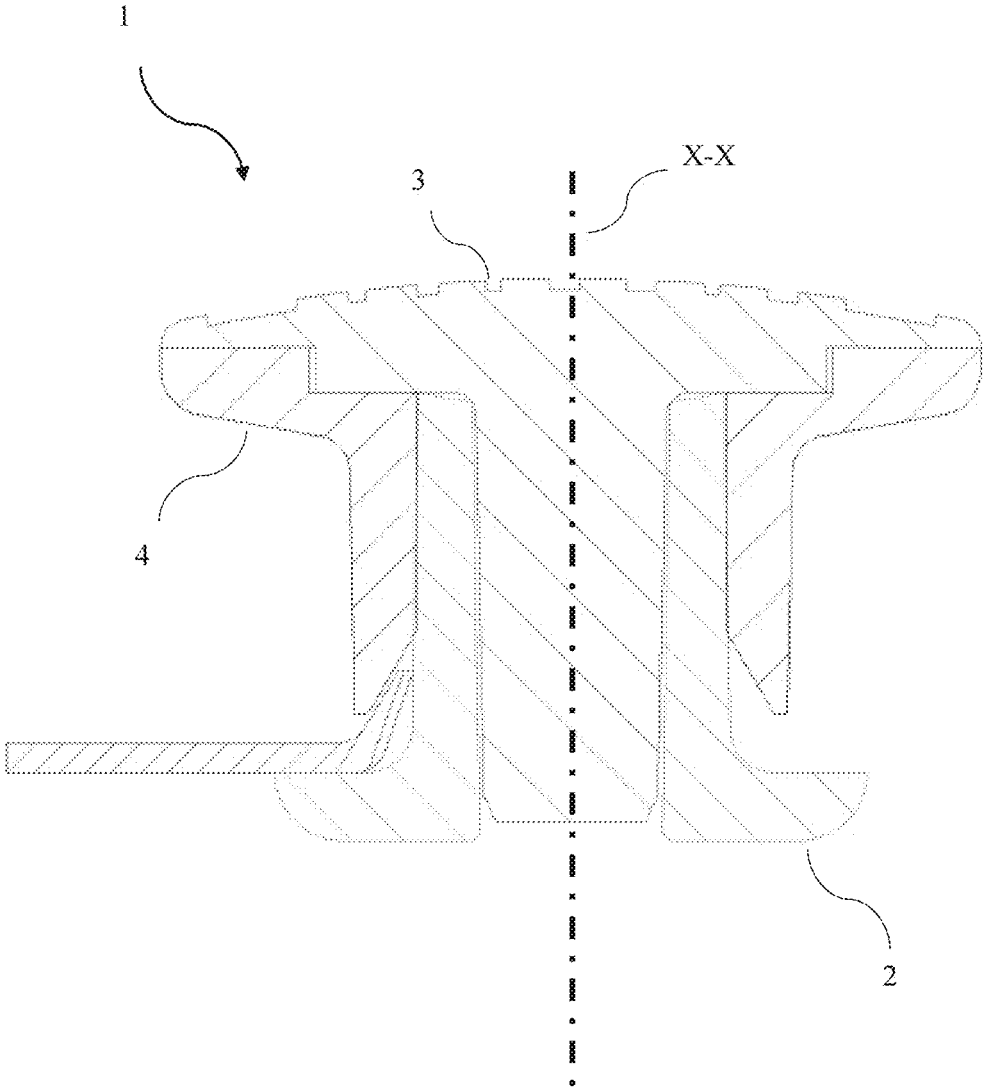
FIG. 1 shows a longitudinal sectional view of a decorative button for clothing in accordance with the present invention.
Figure 2:
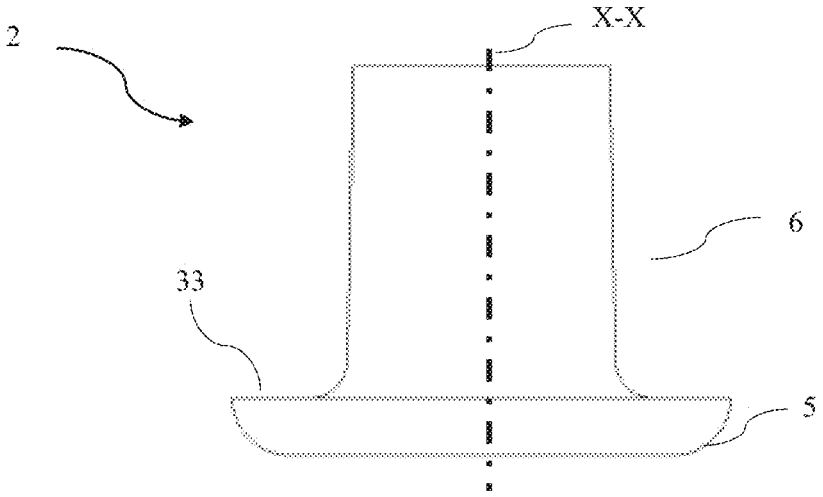
FIG. 2 shows a detail of the decorative button of FIG. 1.
Figure 3:
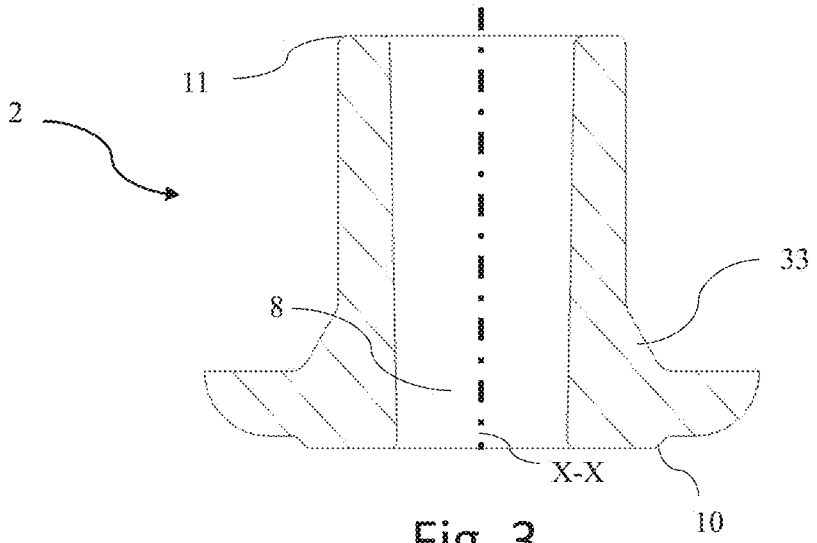
FIG. 3 shows a longitudinal sectional view of the detail of FIG. 2.
Figure 4:
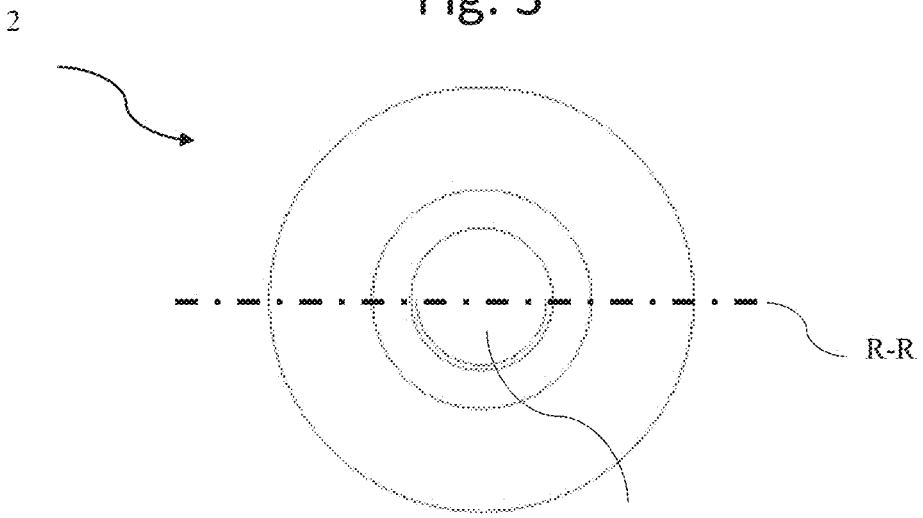
FIG. 4 schematically shows a top view of a detail of the decorative button of FIG. 1.
Figure 5:
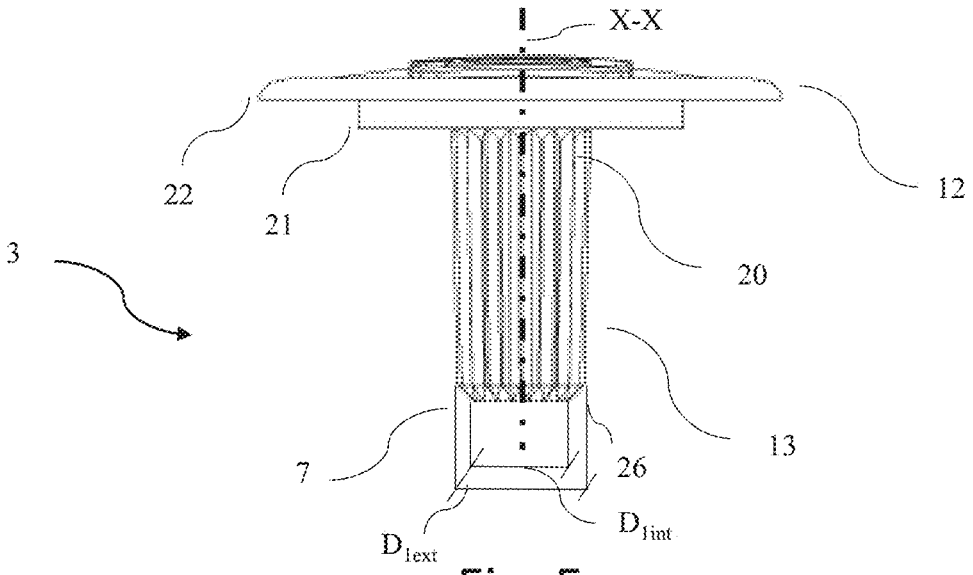
FIG. 5 shows a detail of the decorative button of FIG. 1.
Figure 6:
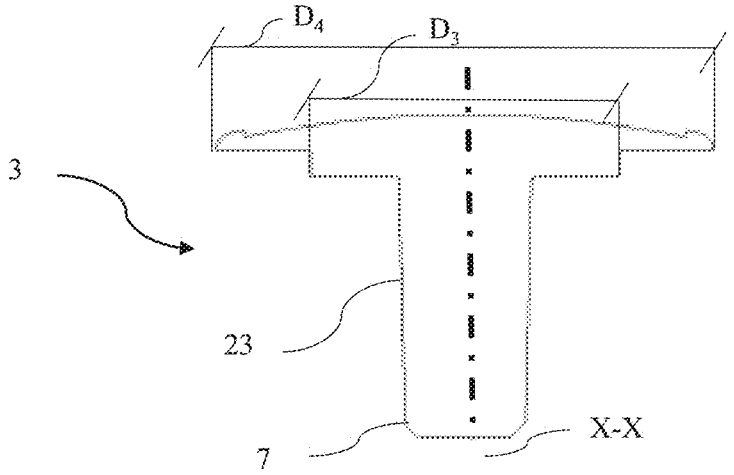
FIG. 6 shows a longitudinal sectional view of the detail of FIG. 5.
Figure 7:
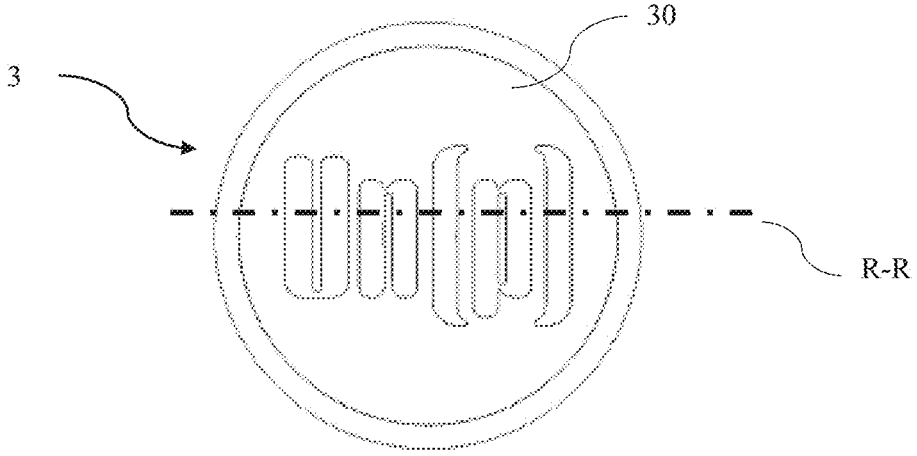
FIG. 7 schematically shows a top view of a detail of the button of FIG. 1.
Figure 8:
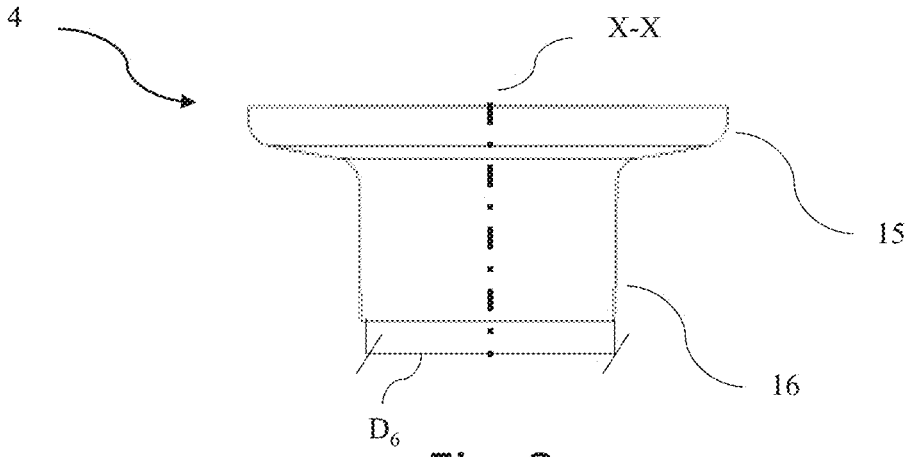
FIG. 8 shows a detail of the decorative button of FIG. 1.
Figure 9:
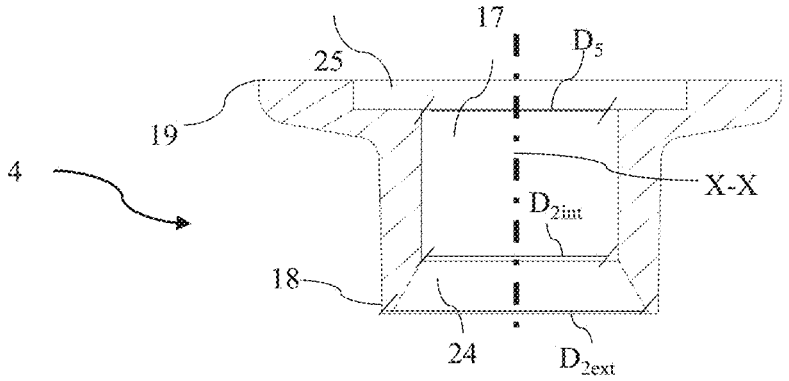
FIG. 9 shows a longitudinal sectional view of the detail of FIG. 8.
Figure 10:
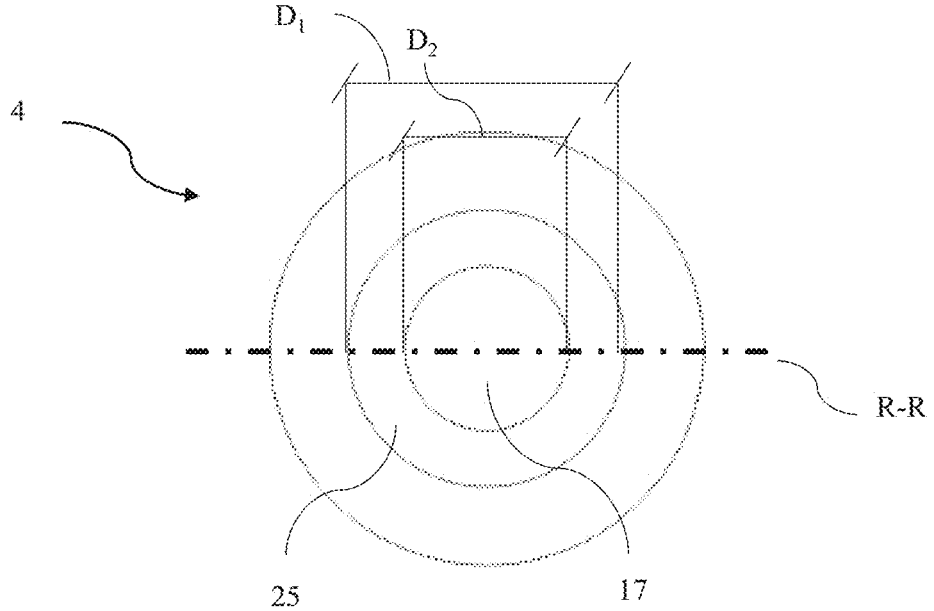
FIG. 10 schematically shows a top view of a detail of the button of FIG. 1.

The present invention relates to a button 1 for clothing, schematically illustrated in longitudinal section in FIG. 1.

The button 1 comprises a bottom element 2, a closing element 3 and a fixing element 4. The bottom element 2 comprises a stem 6, defined by a diameter $D_6$, which extends along an axial direction X-X. The closing element 3 comprises a pin 13 which extends along the same axial direction X-X and extends internally to the stem 6. Specifically, the pin 13 is configured to bind to the stem 6. Finally, the fixing element 4 comprises a trunk 16 extending along the same axial direction X-X and externally to the stem 6. The trunk 16 is configured to receive and bind to the stem 6.

The stem 6 is configured to be coupled with interference fit internally with the pin 13 and externally with the trunk 16, so that the trunk 16 causes a radial clamping action on the stem 6 and, through the stem 6, on the pin 13. It should be noted that the coupling with interference fit internally between the stem 6 and the pin 13 and externally between the stem 6 and the trunk 16 allows the pin 13 to be constrained along the axial direction X-X, along a radial direction R-R perpendicular to the axial direction X-X and rotationally constrained around the axial direction X-X.

In accordance with a preferred embodiment, the fixing element 4 comprises a flange 15 from which the trunk 16 axially extends. Preferably, the flange 15 extends along a plane perpendicular to the axial direction X-X and has a first annular seat 25 defined by a first diameter $D_1$ and by a second diameter $D_2$ smaller than the first one $D_1$. Advantageously, said annular seat 25 is configured to receive and be coupled with the closing element 3.

In accordance with an embodiment of the invention, the flange 15 is fixed to the stem 6. Preferably, the fixing element 4 is built in one piece.

According to an embodiment, the fixing element 4 has a through opening 17 extending in axial direction X-X between a first end 18 and a second end 19 of the fixing element 4, which is defined by a diameter $D_5$ corresponding to the second diameter $D_2$ of the annular seat 25. It should be noted that the through opening 17 is configured to receive and be coupled with the stem 6.

According to a preferred embodiment, the fixing element 4 has a countersink 24 internally to the trunk 16 at the first end 18 of the fixing element 4. Preferably, the countersink 24 is arranged in a radial direction R-R towards the through opening 17 and is defined by a second outer diameter $D_{2ext}$ and a second inner diameter $D_{2int}$, corresponding respectively to the diameter $D_6$ of the stem 6 and to the second diameter $D_2$ of the annular seat 25. Advantageously, the countersink 24 allows to identify a conical crown at the first end 18 of the fixing element 4, defined, respectively, by the second outer diameter $D_{2ext}$ and by the second inner diameter $D_{2int}$. It should be noted that the conical crown of the countersink 24 is configured to receive and retain a fabric edge between the first end 18 of the fixing element 4 and the bottom element 2.

In accordance with an embodiment, the closing element 3 comprises a head 12 from which the pin 13 axially extends. Preferably, the head 12 extends on a plane perpendicular to the axial direction X-X and has a first portion 21, having a first diameter $D_3$, and a second portion 22, having a second diameter $D_4$ greater than the first diameter $D_3$. Advantageously, the first portion 21 is housed internally to the first annular seat 25 of the flange 15 of the fixing element 4. In the preferred embodiment, the head 12 is configured to be coupled with interference fit with the annular seat 25 of the flange 15 of the fixing element 4. It should be noted that the head 12 is fixed to the pin 13. Preferably, the closing element 3 is built in one piece.

In accordance with an embodiment of the invention, the head 12 has an outer surface 30 comprising engravings 31 adapted to identify the manufacturer. According to an embodiment, the outer surface 30 comprises protrusions 32 adapted to identify the manufacturer of the button 1.

According to one embodiment of the invention, the head 12 may have different shapes of the outer surface 30 according to needs, such as, but not limited to, a concave, domed or flat outer surface 30.

According to a preferred embodiment of the invention, the pin 13 has a lateral surface 23 provided with a plurality of protrusions 20. Preferably, the protrusions 20 extend along a radial direction R-R and extend longitudinally along the axial direction X-X. Advantageously, the protrusions 20 are configured to deform to achieve the coupling with interference fit between the pin 13 and the stem 6.

In accordance with one embodiment, the protrusions 20 have the same extension in axial direction X-X as the pin 13.

According to an embodiment of the invention, each protrusion 20 is arranged at an equal distance from adjacent protrusions 20.

Preferably, the pin 13 of the closing element 3 has a free end 7 and a chamfer 26 at the free end 7 for easier insertion and coupling to the stem 6 of the bottom element 2. Preferably, the chamfer 26 is arranged in a radial direction R-R and is defined by a first outer diameter $D_{1ext}$ and a first inner diameter $D_{1int}$ smaller than the first outer diameter $D_{1ext}$.

In accordance with a preferred embodiment of the invention, the bottom element 2 has a through cavity 8 extending in an axial direction X-X between a first end 10 and a second end 11 of the bottom element 2.

Advantageously, the through cavity 8 is configured to receive the pin 13 of the closing element 3.

In accordance with an embodiment, the through cavity 8 has an inner surface 35 (not shown in the enclosed figures) provided with grooves 36 (not shown in the enclosed figures) extending along the radial direction R-R. Preferably, the grooves 36 have the same radial extension as the protrusions 20 of the pin 13. Advantageously, the grooves 36 are configured to be coupled with the protrusions 20.

According to a preferred solution of the invention, the bottom element 2 also has a base 5 at the first end 10, which extends along the radial direction R-R and has a second annular seat 33 configured to receive the first end 18 of the fixing element 4.

In accordance with the preferred solution of the invention, the base 5 of the bottom element 2 is fixed to the stem 6. Preferably, the bottom element is built in one piece.

Preferably, the base 5 has a bottom surface 37 extending on a plane perpendicular to the axial direction X-X and an edge 38 extends axially from the bottom surface 37. Advantageously, the second annular seat 33 is delimited by the stem 6, the bottom surface 37 and the edge 38.

Preferably, the bottom element 2 and the fixing element 4 have a tubular geometry, preferably cylindrical, and an axis having axial direction X-X.

The invention therefore makes it possible to make a decorative button 1 for clothing, the bottom element 2 and the closing element 3, and a third element adapted to fix them irreversibly, namely the fixing element 4.

One possible application of the invention consists in an item of clothing 100 to which the button 1 is coupled. Preferably, the item of clothing 100 comprises a buttonhole 101 and a button 1 in accordance with the preferred embodiment. Still preferably, the bottom element 2 is configured to be inserted internally to the buttonhole 101 and retain a fabric edge of said buttonhole 101 between the base 5 and the first end 18 of the fixing element 4. Advantageously, the fabric edge is retained by the countersink 24 of the fixing element 4 internally to the first annular seat 25 and to the second annular seat 33.

The invention claimed is:

1. Button comprising:

a bottom element which comprises a stem extending along an axial direction, a closing element which comprises a head extending on a plane perpendicular to the axial direction and including a first portion having a first diameter and a second portion having a second diameter greater than the first diameter, and a pin extending along the axial direction from the head internally to the stem, the pin being configured to bind to the stem, a fixing element including a flange extending on a plane perpendicular to the axial direction and having a first annular seat defined by a first diameter and a second diameter smaller than the first diameter, and a trunk extending along the axial direction form the flange externally to the stem, the trunk being configured to receive and bind to the stem, wherein the first portion of the head is housed into and coupled with the first annular seat of the fixing element; and the stem is configured to be coupled with interference fit internally with the pin and externally with the trunk so that the trunk causes a radial clamping action on the stem and, through the stem, on the pin.

2. The button according to claim 1, wherein the first portion of the head is configured to be coupled with interference fit with the annular seat of the flange.

3. The button according to claim 1, wherein the pin has a free end and a chamfer at the free end, the chamfer being made in a radial direction and being defined by a first outer diameter and a first inner diameter smaller than the first outer diameter.

4. The button according to claim 1, wherein the bottom element has a through cavity extending in the axial direction between a first end and a second end of the bottom element, the through cavity being configured to receive the pin.

5. The button according to claim 1, wherein the bottom element has a base at a first end extending along a radial direction, the base having a second annular seat configured to receive a first end of the fixing element.

6. Button comprising:

a bottom element which includes a stem extending along an axial direction, a closing element which includes a pin extending along the axial direction internally to the stem, the pin being configured to bind to the stem and having a lateral surface provided with a plurality of protrusions extending along a radial direction and developing longitudinally along the axial direction, a fixing element comprising a trunk extending along the axial direction externally to the stem, the trunk being configured to receive and bind to the stem, wherein the stem is configured to be coupled with interference fit internally with the pin and externally with the trunk so that the trunk causes a radial clamping action on the stem and, through the stem, on the pin, and wherein the protrusions are configured to deform to be coupled with interference fit between the pin and the stem.

7. Button comprising:

a bottom element which includes a stem extending along an axial direction, a closing element which includes a pin extending along the axial direction internally to the stem, the pin being configured to bind to the stem, a fixing element including:

a flange extending on a plane perpendicular to the axial direction and having a first annular seat defined by a first diameter and a second diameter smaller than the first diameter, the first annular seat being configured to receive and be coupled with the closing element;

a trunk extending along the axial direction from the flange externally to the stem and configured to receive and bind to the stem, and an internal countersink extending in a radial direction at a first end to identify a conical crown defined by a second outer diameter and a second inner diameter, the second inner diameter corresponding to the second diameter of the first annular seat, wherein the stem is configured to be coupled with interference fit internally with the pin and externally with the trunk so that the trunk causes a radial clamping action on the stem and, through the stem, on the pin, and wherein the countersink of the fixing element is configured to receive and retain a fabric edge of a buttonhole between the first end of the fixing element and the bottom element.

* * * * *